US011877660B2

(12) United States Patent
Plant et al.

(10) Patent No.: US 11,877,660 B2
(45) Date of Patent: Jan. 23, 2024

(54) STADIUM SEAT

(71) Applicant: Blue Cube (GB) Ltd, London (GB)

(72) Inventors: Russell Plant, London (GB); Daniel Ho, London (GB)

(73) Assignee: BLUE CUBE (GB) LTD., London (GB)

( * ) Notice: Subject to any disclaimer, the term of this patent is extended or adjusted under 35 U.S.C. 154(b) by 0 days.

(21) Appl. No.: 17/231,106

(22) Filed: Apr. 15, 2021

(65) Prior Publication Data

US 2021/0321776 A1 Oct. 21, 2021

(30) Foreign Application Priority Data

Apr. 17, 2020 (GB) ..... 2005622

(51) Int. Cl.
*A47C 1/16* (2006.01)
*A47C 7/44* (2006.01)

(52) U.S. Cl.
CPC ..... *A47C 1/16* (2013.01); *A47C 7/444* (2018.08)

(58) Field of Classification Search
CPC .. A47C 1/16; A47C 1/121; B60N 2/20; B60N 2/3011
USPC ..... 297/301.3, 217.7, 378.1
See application file for complete search history.

(56) References Cited

U.S. PATENT DOCUMENTS 3,066,980 A * 12/1962 Clute ..... A47C 1/16 297/252
5,590,619 A * 1/1997 Meador ..... B63B 29/06 248/500
7,303,235 B1 * 12/2007 Fongers ..... A47C 1/121 297/217.7
7,543,890 B1 * 6/2009 Sasaki ..... B60N 2/206 297/378.1
2010/0223718 A1 * 9/2010 Andersen ..... A47K 13/10 4/242.1
2019/0313863 A1 * 10/2019 Laundre ..... A47K 13/12

* cited by examiner

*Primary Examiner* — Sarah B McPartlin
(74) *Attorney, Agent, or Firm* — Nutter McClennen & Fish LLP

(57) ABSTRACT

A chair comprising a seat base, a back rest, the back rest having a first arm connected to the seat base by a first pivot and a second arm connected to the seat base by a second pivot so that the back rest can pivot between a first folded position and a second position, the first pivot being biased so that in the absence of any force applied by a user, the back rest maintains the first position wherein a damper is included to ensure to retard the movement of the seat from the second position to the first position in the absence of any force applied.

13 Claims, 7 Drawing Sheets

STADIUM SEAT

CROSS REFERENCE TO RELATED APPLICATION

This patent application claims priority under 35 U.S.C. § 119 from UK patent application GB2005622.2, filed Apr. 17, 2020, the entire contents of which is incorporated by reference herein.

FIELD

The present specification relates to stadium seats, particularly for seats for simple stadia seats known as bleachers or bench seats.

BACKGROUND

Many stadiums and sports grounds, particularly in the US, use cheap seating known as 'bleachers', which comprise simple planks arranged in a step-like formation for people to sit on.

These bleachers are inexpensive, and used extensively. The seating is uncomfortable, however completely replacing them with stadium seats is prohibitively expensive and special constraints can limit this upgrade. There are more comfortable seating designs which can be attached to bleachers, however these are inconvenient to fit; further, any such seating should adhere to current safety practices and local fire and safety codes.

SUMMARY

The object of the present invention is to provide a seat that can be conveniently attached to a bleacher or similar simple seating plank, and which conforms to safety practices and local fire and safety codes.

According to the present invention, there is provided a chair according to claim 1. According to another aspect of the present invention, there is provided a chair according to claim 8.

BRIEF DESCRIPTION OF THE DRAWINGS

The invention will now be described, by way of example, with reference to the drawings, of which

DETAILED DESCRIPTION

Figure 1:
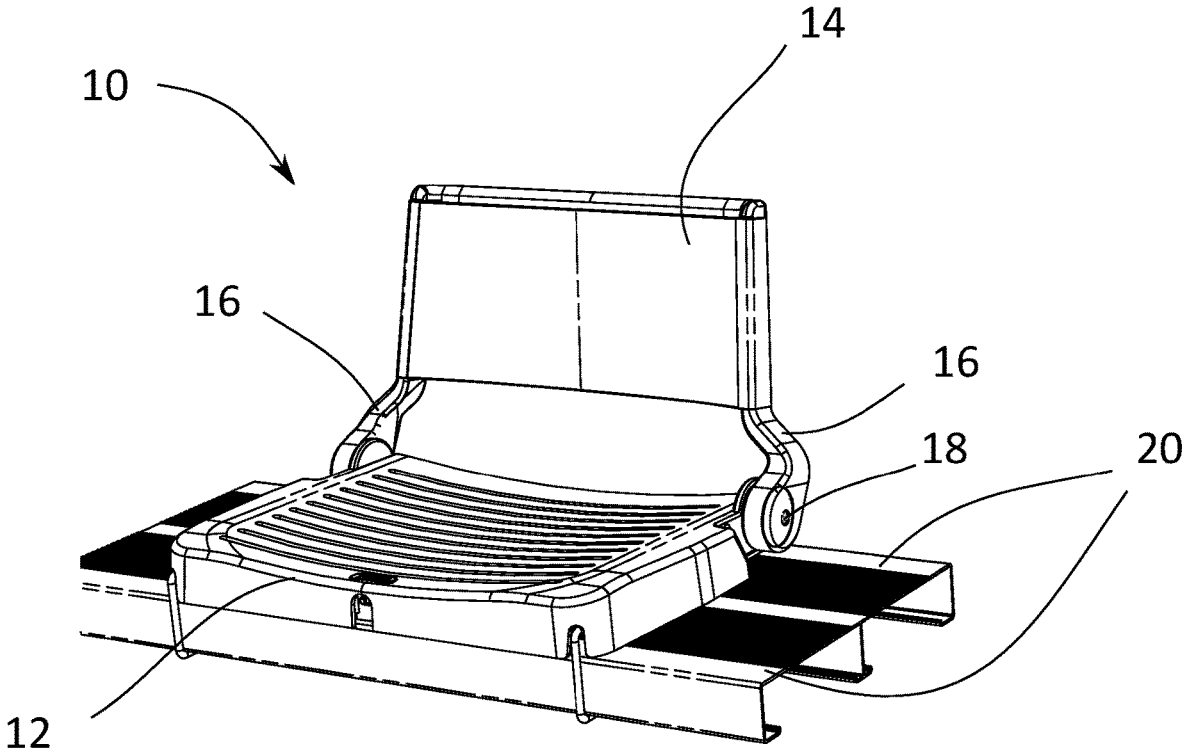
FIG. 1 is a perspective view of part of a bleacher, with a chair attached to it.

Referring to FIG. 1, a chair 10 for a bleacher comprises a seat base 12, a back member 14, the back rest 14 being supported on two arms 16, each arm 16 being pivotally attached to the seat member 12 by a hinge 18.

Figure 2:
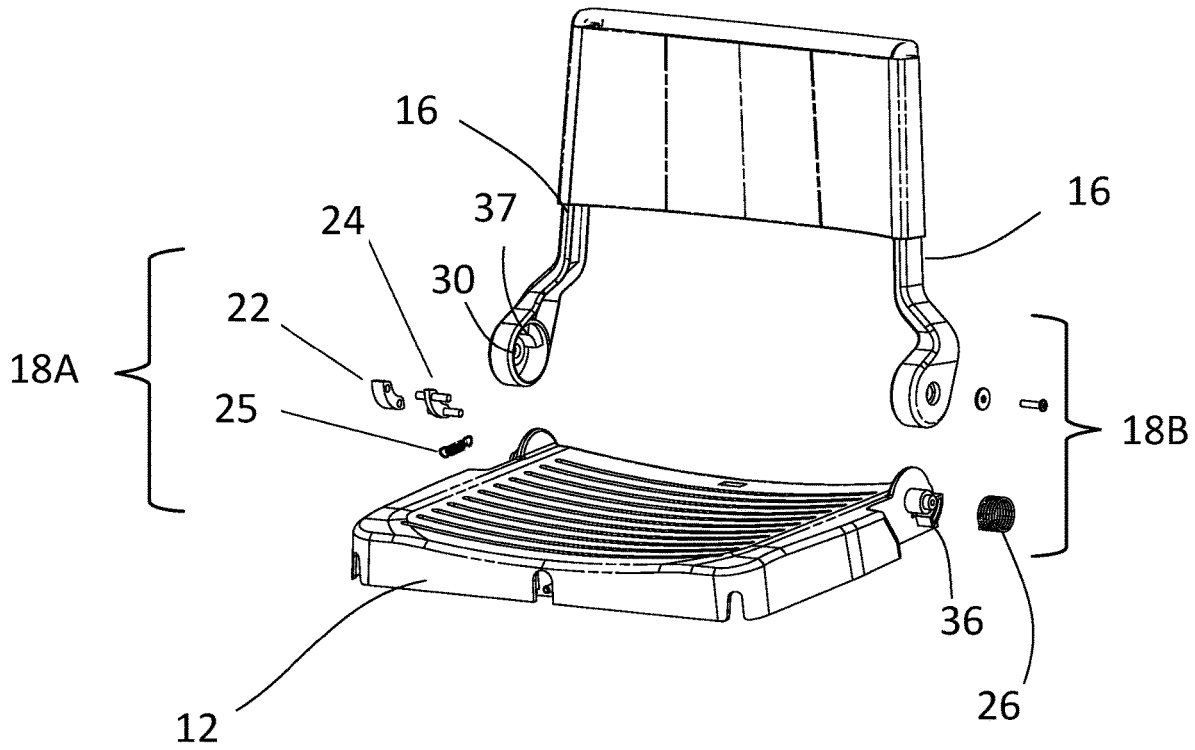
FIG. 2 is an exploded perspective view of the chair.

Referring to FIG. 2, the hinges are dissimilar; on the right side of the chair 10, the right back rest arm 16 pivots about a break hinge 18A, while on the left side of the chair 10, the left back rest arm 16 pivots about a bias hinge 18B.

Figure 3:
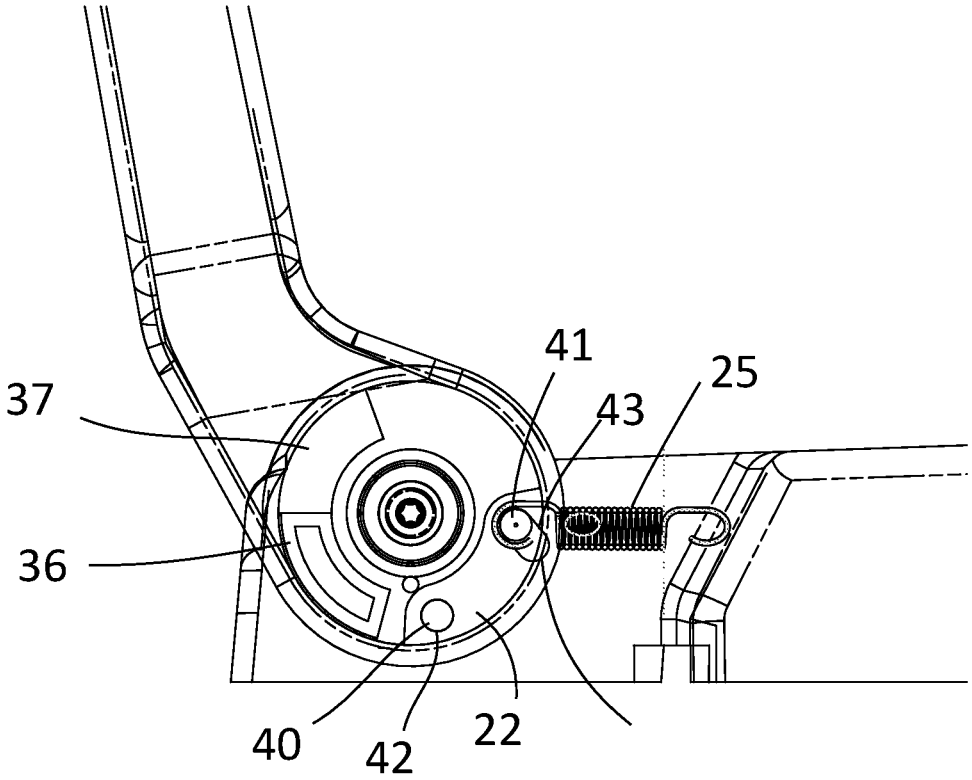
FIG. 3 is a section side elevation of a first hinge of the chair.

Referring also to FIG. 3, seat base 12 includes a hinge pin 28 on each side of the seat base 12 at or towards the rear of the seat base 12 at each hinge 18 for attachment of the two back rest arms 16. Each back rest arm 16 includes a hinge recess 32 which forms a cavity when each back rest arm 16 is assembled with the seat base 12, provides a compartment for parts of each hinge which will be described in more detail below. A hinge bore 30 leading from each hinge recess 32, receives the hinge pin 28 for the respective hinge 18, so that the back rest arm 16 can pivot about the hinge pin 28. The back rest 14 is rigid, so that when assembled, both hinges 18 operate together, allowing the back rest 14 to be pivoted downwards to lie against the seat base 12 in a folded position, or pivoted upwards to a near vertical position to support a user's back when seated.

Figure 4:
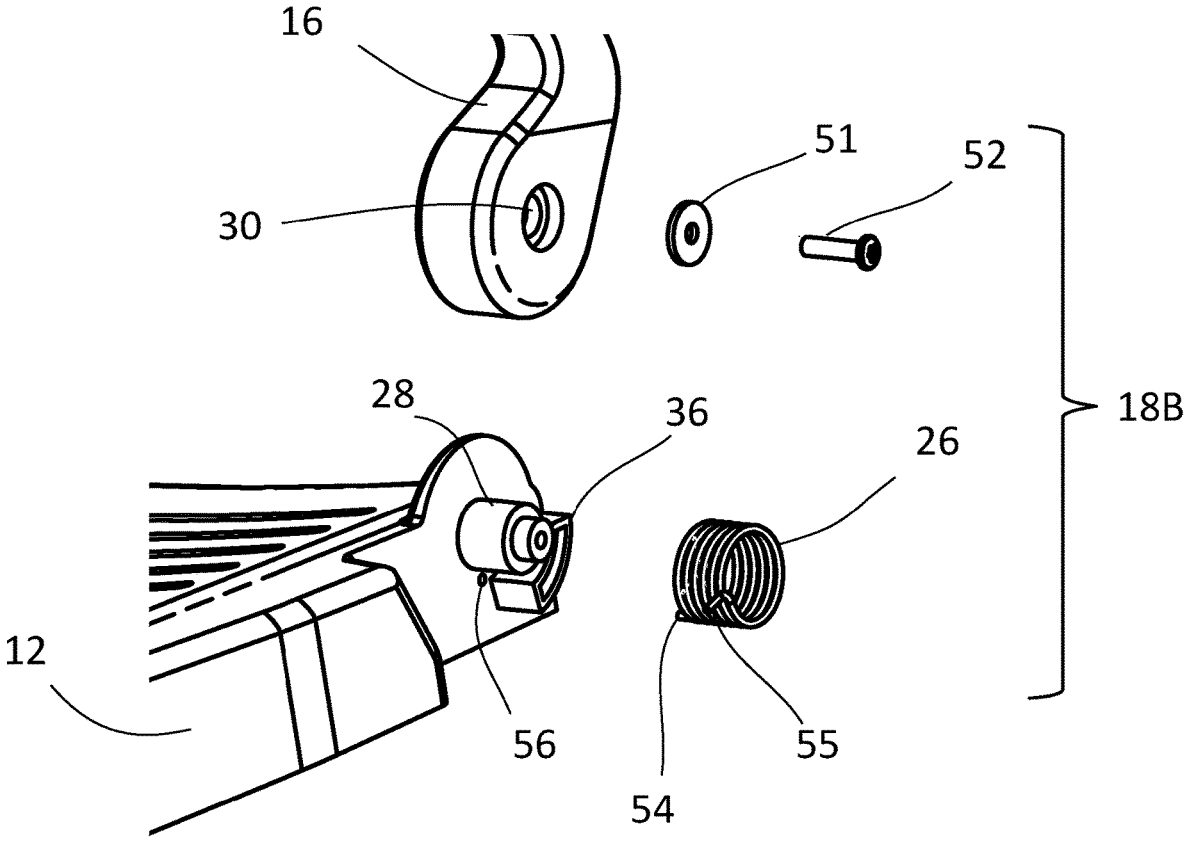
FIG. 4 is an exploded perspective view of a second hinge of the chair.

A limiter 36 is provided on the seat base 12 near each hinge pin 28. A similar limiter 37 is provided within each hinge recess 32. The limiter 36 and limiter 37 of each hinge 18 include surfaces that abut when the back rest arm 16 is in the fully folded position, and in the fully open position, to limit the movement of the back rest 14. Referring also to FIG. 4, the limiter 36 may conveniently take the form of an arcuate wedge extended around or near to the hinge pin 28, while the limiter 37 may conveniently take a similar form in the hinge recess 32 of each back rest arm 16.

The hinges 18 are dissimilar, the right side of the chair 10 bearing a break hinge 18A, while the left side of the chair 10 bearing a bias hinge 18B. Obviously, the break hinge 18A and bias hinge 18B could be reversed.

Referring to FIGS. 2 and 4, the break hinge 18A includes a break pad carrier 24 and a break pad 22. The break pad carrier 24 includes two studs 40, 41 which extend in both directions from the break pad carrier 24. On one side of the break pad carrier 24, the studs 40, 41 engage with corresponding holes in the break pad 22, while on the other side of the break pad carrier 24, the studs 40, 41 engage with holes 42, 43 in the seat base 12. The hole 42 is circular and corresponds to the stud 40. The hole 43 is obround, so that the stud 41 can slidably move in the obround hole 43. One end of a tension spring 25 is attached to the stud 41, with the other end of the tension spring 25 being attached to the seat base 12.

The hinge recess 32 is circular, and break pad 22 is arcuate shaped, with the inner surface of the hinge recess 32 and the outer surface of the break pad 22 having a similar curvature. When the break hinge 18A is assembled, the break pad 22 presses against the inner surface of the hinge recess 32, and is kept in close contact with the inner surface of the hinge recess 32 by the force of the tension spring 25. This creates a resistance to the pivoting movement of the break hinge 18A, and consequently slows or damps the folding of the chair. The obround hole 43 allows the break pad carrier 24 and break pad 22 to be continually urged against the inner surface of the hinge recess 32, so that the damping effect is present even after wear of the break pad 22 or if manufacturing tolerance are imprecise.

Referring to FIG. 4, the bias hinge 18B includes a torsion spring 26, arranged coaxial and around the hinge pin 28 of bias hinge 18B. One end 54 of the torsion spring 26 is connected to a attachment hole 56 the seat base 12, while the other end 55 of the torsion spring 26 engages with a receiving hole (not shown) in the hinge recess 32 of the back rest arm 16. When person applies force to the back rest 14 to fold it towards the seat base 12, the torsion spring 26 to become energized and wound more tightly, so that when the back rest 14 is released, the back rest 14 rest is urged back to the upright position. Alternatively, the torsion spring 26 could be configured so that the seat is biased in the folded position, so that a person has to apply an upward force to the back rest 14 to sit on the seat, the back rest 14 returning to the folded position against the seat base 12 when the force is released.

A washer 51 and bolt 52 which engages with the hinge pin 28 through the hinge recess 32 may be used to secure the back rest arm 16 to the seat base 12.

The break hinge mechanism described here uses a compression spring; the bias hinge mechanism uses a torsion spring. However, both the break hinge mechanism and bias hinge mechanism could be implemented using compression, tension or torsion springs, or similar resilient members. The break hinge mechanism and bias hinge mechanism could also be contained within a single hinge, with the other hinge being freely moveable or carrying out some other function.

Figure 5:
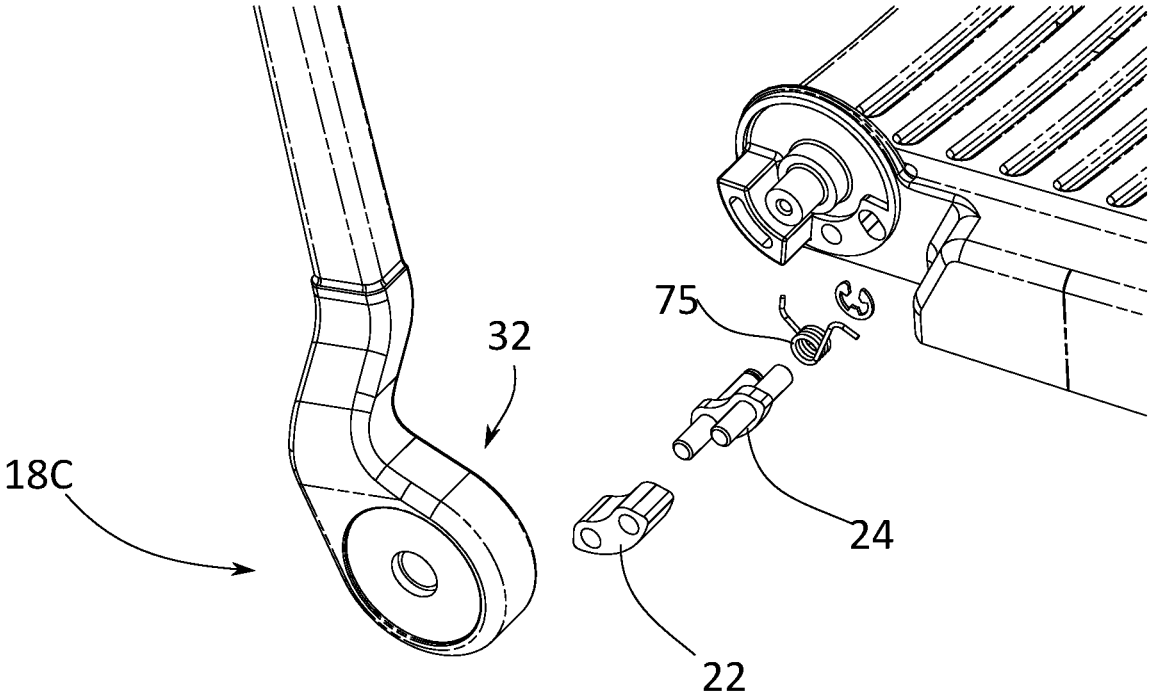
FIG. 5 is an exploded perspective view of another embodiment of the first hinge of the chair.
Figure 6:
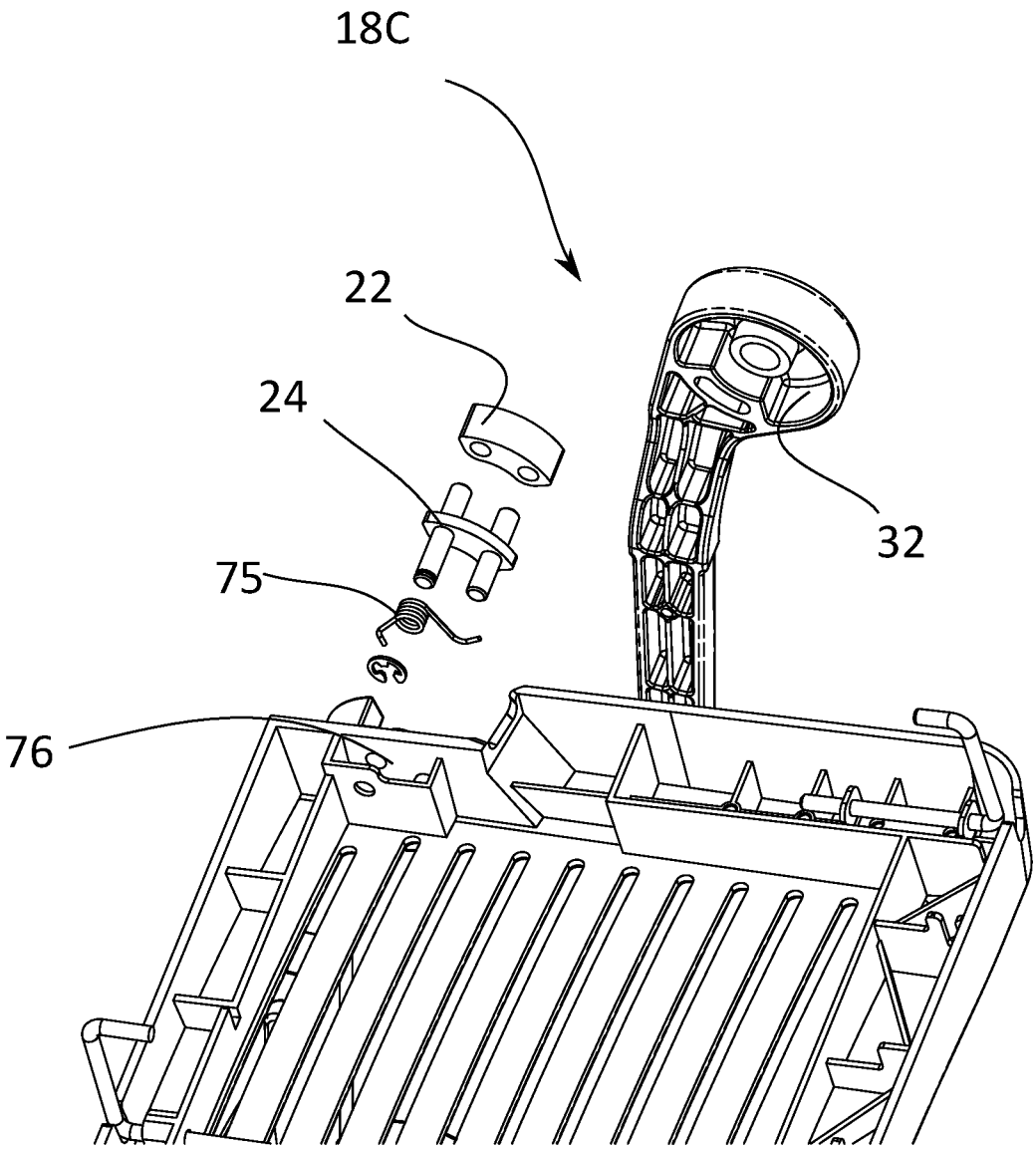
FIG. 6 is an exploded perspective view from the underside of this embodiment of the first hinge of the chair.

Referring to FIG. 5, an alternative embodiment of the break hinge 18C comprises a break pad 22 mounted on a break pad carrier 24 as previously described. As in the previous embodiment, the break pad 22 bears against the inner surface of the hinge recess 32. In this embodiment, the break pad 22 is urged against the inner surface of the hinge recess 32 by a force applied by a torsion spring 75. One end of the torsion spring is constrained against the seat base 12, while the other end is bears against the break pad carrier 24, so that a continual outwardly radial force is applied to the break pad 22. Referring to figure to FIG. 6, the body of the torsion spring 75 may be conveniently located in a compartment 76 formed in the seat base 12 so that the position of the torsion spring 75 is constrained, with the end of the torsion spring 75 that bears against the break pad carrier 24 extends through an aperture in the compartment 76.

Figure 7:
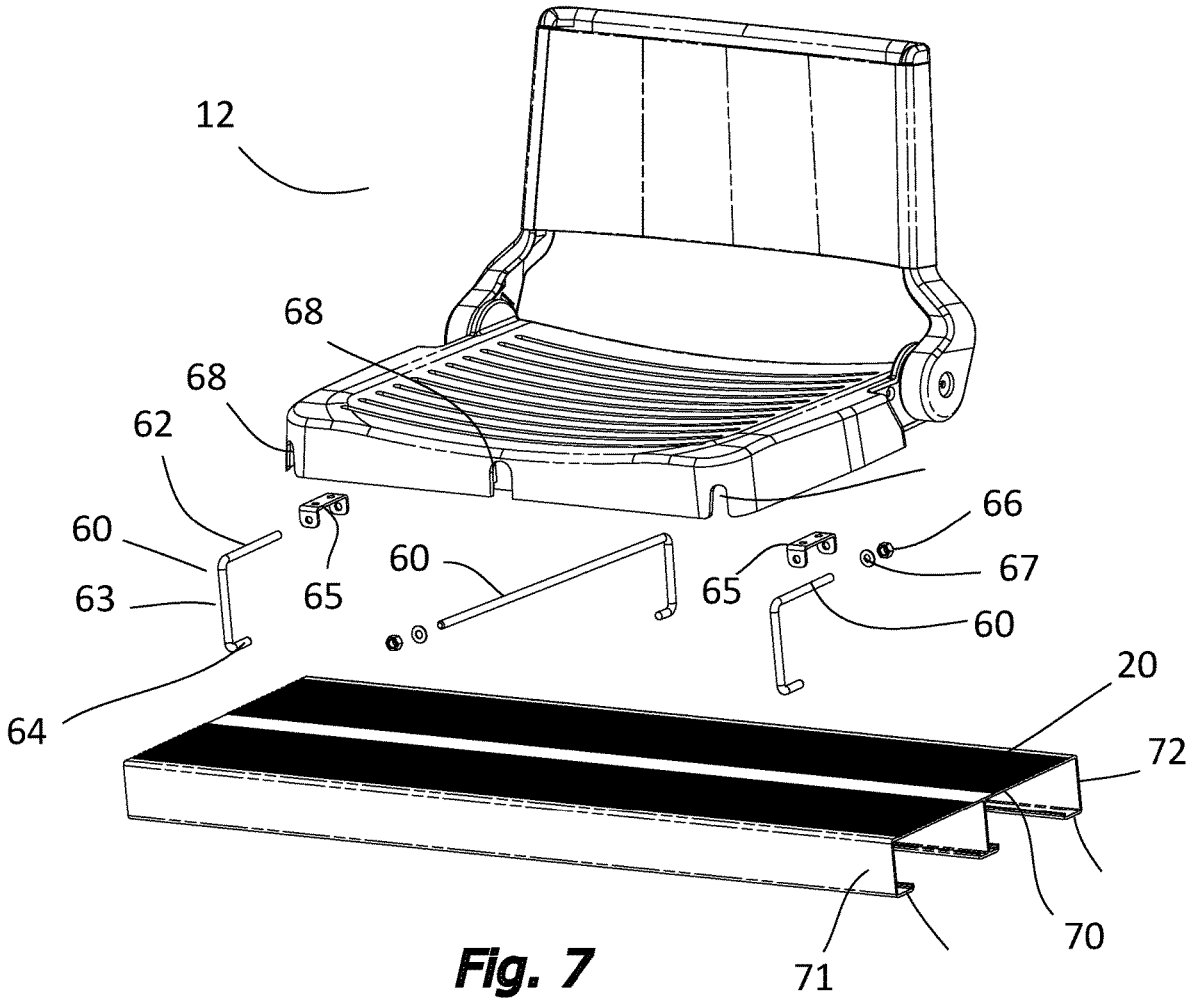
FIG. 7 is an exploded perspective view of the chair showing details of the attachment to a bleacher.

Referring to FIG. 7, the seat base 12 is attached to the bleacher plank 20 by means of j-hooks 60. Each j-hook 60 comprises a rigid shaped rod having a horizontal section 62, vertical section 63, and return section 64 (which is also substantially horizontal). The bleacher plank 20 has an upper surface 70, front edge 71 and back edge 72, typically the front edge 71 and back edge 72 are perpendicular to the upper surface 70. The bleacher plank 20 may be wood, but more usually is formed from extruded metal sections.

The horizontal section 62 of each j-hook 60 engages with bores or holes provided on the underside of the seat base 12. These may either be integrally formed with the seat base 12 such as using moulded plastic, or may be provided by u-plates 65 which are secured to the underside of the seat base 12. Each u-plate 65 has two lugs having holes formed in them, through which the horizontal section 62 of j-hook 60 is introduced, though a single-holed bracket or retaining shape could be used. The free end of each j-hook 60 (that is, the end opposite the vertical section 63 and return section 64) has a thread upon which a washer 67 and nut 66 can be threaded. The seat base 12 also has apertures 68 to permit access of a nut driver.

The j-hooks 60 are arrange so that at least one j-hook 60 engages with the front edge 71 of the bleacher plank 20, and one j-hook 60 engage with the back edge 72 of the bleacher plank 20. Ideally, three j-hooks 60 are provided, to resist any turning forces on the chair 10 and give stability; in this example, one j-hook 60 is shown with the hook positioned to hook over the front edge 71 of the bleacher plank 20 and two j-hooks 60 positioned to hook over the back edge 72 of the bleacher plank 20.

To engages each j-hook 60 with the bleacher plank 20, the vertical section 63 and horizontal section 62 of each j-hook 60 are positioned on the bleacher plank 20 to extend beyond the front edge 71 or back edge 72 as necessary, and then the washer 67 and nut 66 of each j-hook 60 are tightened using a nut driver though the apertures 68, so that each nut 66 bear against the respective u-plate 65 or other similar formation on the underside of the seat base 12. This draws each j-hook 60 towards the bleacher plank 20 so that the vertical section 63 and horizontal section 62 of each j-hook 60 grips the bleacher plank 20. The chair 10 is then secured to the bleacher plank 20.

Alternatively, one or more j-hooks 60 oriented similar could be provided to which can be tightened against one edge of the bleacher plank 20, with a fixed hook or clip on the opposite side of the seat base 12.

The j-hooks and other chair attachment hardware is an integral part of the seating system and arrives complete to site for rapid installation, so that the installer simply positions the chair on the bleacher planks and then tightens the j-hooks to the extent necessary to secure and constrain the chair against the bleacher plank.

This self-folding backrest innovation allows for a larger more comfortable chair when occupied when unoccupied the row spacing for egress remains code compliant.

The invention claimed is:

1. A bleacher chair comprising:

a seat base comprising a plurality of bleacher attachment elements including at least one front bleacher attachment element configured to grip a front edge of a bleacher plank and at least one back bleacher attachment element configured to grip a back edge of the bleacher plank, wherein at least one of the plurality of bleacher attachment elements includes a j-hook attachment element comprising a rigid shaped rod having a horizontal section, a vertical section, and a return section, wherein the horizontal section is slidably secured to the seat base through at least one bore or hole on an underside of the seat base with a tightener that threads onto a free end of the j-hook opposite the vertical section and bears against the seat base to draw the j-hook toward the bleacher plank so that the j-hook grips the bleacher plank to secure the bleacher chair to the bleacher plank;

a back rest, wherein the back rest comprises a first arm connected to the seat base by a first pivot and a second arm connected to the seat base by a second pivot so that the back rest pivots between a first folded position and a second upwards position, wherein the first pivot comprises a bias hinge so that in an absence of any force applied by a user, the back rest is urged to the first folded position wherein the rest is biased toward the first folded position such that a person has to apply an upward force to the back rest to sit on the seat base and the back rest returns to the first folded position against the seat base when the force is released; and a damper that slows or damps the pivoting of the back rest from the second upwards position to the first folded position.

2. A bleacher chair according to claim 1, wherein the damper engages with the second pivot.

3. A bleacher chair according to claim 1, wherein the damper comprises a friction surface secured to an arm, which bears against a bearing surface secured to the seat base.

4. A bleacher chair according to claim 3, wherein the damper is urged against the bearing surface by a resilient member.

5. A bleacher chair according to claim 1, wherein the first pivot comprises a torsion spring that resists a pivoting movement from the first folded position to the second upwards position.

6. A bleacher chair according to claim 1, wherein:

when the back rest is in the second upwards position, the bleacher chair is not in a code compliant state; and when the back rest returns to the first folded position from the second upwards position, the bleacher chair returns to the code compliant state.

7. A bleacher chair according to claim 1, wherein:

when the back rest is in the second upwards position, the back rest is pivoted beyond a vertical plane at a back edge of the seat base to extend into a space behind the back edge of the seat base.

8. A bleacher chair according to claim 1, including two front j-hook attachment elements and one back j-hook attachment element.

9. A bleacher chair according to claim 1, wherein the at least one front bleacher attachment element comprises a fixed hook or clip and wherein the at least one back bleacher attachment element comprises at least one j-hook attachment element.

10. A bleacher chair according to claim 1, wherein the at least one back bleacher attachment element comprises a fixed hook or clip and wherein the at least one front bleacher attachment element comprises at least one j-hook attachment element.

11. A bleacher chair according to claim 1, wherein the at least one bore or hole on the underside of the seat base is integrally formed with the seat base.

12. A bleacher chair according to claim 1, wherein the at least one bore or hole on the underside of the seat base is provided by at least one u-plate secured to the underside of the seat base.

13. A bleacher chair according to claim 1, wherein the seat base includes an aperture to permit access to the tightener of the j-hook attachment element.

* * * * *